US006090054A

United States Patent [19]

Tagishi et al.

[11] Patent Number: 6,090,054

[45] Date of Patent: Jul. 18, 2000

[54] ULTRASONIC WAVE COSMETIC DEVICE

[75] Inventors: Hiroyuki Tagishi, Hikone; Toshihiro Sakamoto, Shiga; Kazuyasu Ikadai, Hikone, all of Japan

[73] Assignee: Matsushia Electric Works, Ltd.

[21] Appl. No.: 09/097,113

[22] Filed: Jun. 12, 1998

[30] Foreign Application Priority Data

Jun. 13, 1997 [JP] Japan ..... 9-157200

[51] Int. Cl.[7] ..... A61H 1/00

[52] U.S. Cl. ..... 601/2; 601/15

[58] Field of Search ..... 601/2, 19, 46, 601/52, 15; 607/98

[56] References Cited

U.S. PATENT DOCUMENTS

| | | | |
|---|---|---|---|
| 2,183,726 | 12/1939 | Sommer et al. | 128/24.1 |
| 3,828,769 | 8/1974 | Mettler | 128/24 |
| 4,787,373 | 11/1988 | Vogel | 128/24.1 |
| 4,823,042 | 4/1989 | Coffey et al. | 310/322 |
| 5,176,130 | 1/1993 | Kim | 250/495.1 |
| 5,690,608 | 11/1997 | Watanabe et al. | 601/19 |
| 5,755,753 | 5/1998 | Knowlton | 607/98 |

*Primary Examiner*—Marvin M. Lateef
*Assistant Examiner*—Eleni Mantis Mercader
*Attorney, Agent, or Firm*—Muramatsu & Associates

[57] ABSTRACT

An improved ultrasonic wave cosmetic device which is able to protect skin against burns. The ultrasonic wave cosmetic device for treating skin includes a probe head having a skin contact metal surface for contacting the skin to transmit an ultrasonic wave thereto, an ultrasonic wave vibration element for vibrating at an ultrasonic wave frequency in response to an output signal from an ultrasonic wave oscillation circuit, and a temperature sensor mounted in a manner directly contacting a side surface of the ultrasonic wave vibration element and a surface opposite the skin contact metal surface for detecting the temperature of the probe head. The temperature sensor feeds back signals to the oscillation circuit which terminates the oscillation output signal when the probe head gets too hot.

9 Claims, 7 Drawing Sheets

ULTRASONIC WAVE COSMETIC DEVICE

FIELD OF THE INVENTION

This invention relates to an ultrasonic wave cosmetic device for treating skin, and more particularly, to an ultrasonic wave cosmetic device which has a temperature sensor to maintain the temperature of a probe head of the device within a predetermined range.

BACKGROUND OF THE INVENTION

Ultrasonic waves have a vibration frequency higher than 20,000 Hz in which sounds of the vibration are not recognizable by human ears. Ultrasonic waves have a variety of applications, one of which is ultrasonic skin cleaning for cosmetic or other purposes. An example of an ultrasonic wave cosmetic device in the conventional technology is shown in Japanese Utility Model Registration No. 3015061. In this conventional example, a metallic probe head is provided with an ultrasonic wave vibration element on a surface opposite to a probe head metal surface which directly contacts the skin.

In the conventional ultrasonic wave cosmetic device noted above, the temperature of the ultrasonic wave vibration element as well as the probe head metal surface that contacts the skin (skin contact metal surface) may increase to a level which is too high for human skin. Such an increase in the temperature occurs when the ultrasonic wave vibration element is continuously driven for a long period of time or the ultrasonic wave is concentrated on a fixed point of the skin for a relatively long time. Therefore, one problem with conventional cosmetic devices of this kind is that they may burn or otherwise adversely affect the skin.

SUMMARY OF THE INVENTION

It is an object of the present invention to provide an ultrasonic wave cosmetic device which is capable of regulating the temperature of a probe head of the cosmetic device to protect the skin.

It is another object of the present invention to provide an ultrasonic wave cosmetic device which is capable of sensing the temperature in an area adjacent to an ultrasonic vibration element and a skin contact metal surface to regulate the temperature thereof so as not to exceed a predetermined level.

It is a further object of the present invention to provide an ultrasonic wave cosmetic device which has a temperature sensor to provide an on/off control for operation of an ultrasonic wave oscillation circuit.

It is a further object of the present invention to provide an ultrasonic wave cosmetic device in which an ultrasonic vibration element, cable, connector, and temperature sensor are snugly mounted in a small space of the probe head.

It is a further object of the present invention to provide an ultrasonic wave cosmetic device which can ensure safe operation by having a temperature sensor in a probe head and with a relatively simple structure and low cost.

The ultrasonic wave cosmetic device for treating skin includes a probe head having a skin contact metal surface for contacting the skin to transmit an ultrasonic wave to the skin, an ultrasonic wave vibration element for vibrating at an ultrasonic wave frequency in response to an output signal from an ultrasonic wave oscillation circuit, and a temperature sensor mounted in a manner to directly contact a side surface of the ultrasonic wave vibration element and an opposite surface of the skin contact metal surface for detecting the temperature of the probe head.

Accordingly, the ultrasonic wave cosmetic device of the present invention is able to regulate the temperature of the probe head to protect the skin. The ultrasonic wave cosmetic device can sense the temperature in an area adjacent to the ultrasonic vibration element and the skin contact metal surface to regulate the temperature thereof so as not to exceed the predetermined temperature level. By the temperature sensor in the probe head, the ultrasonic wave cosmetic device can provide an on/off control for operation of the ultrasonic wave oscillation circuit.

The probe head has a cup-like opening in which the ultrasonic wave vibration element is mounted on a bottom surface of the probe head, and a small space is created between the side surface of the ultrasonic wave vibration element and an inner wall of the cup-like opening in which the temperature sensor is mounted. Thus, by directly contacting the ultrasonic wave vibration element and the opposite surface of the probe head, the temperature sensor can immediately detect whether the temperature reaches the higher or lower limits.

In a further aspect of the present invention, the probe head has a cup-like opening in which the ultrasonic wave vibration element is mounted on a bottom surface of the probe head, and a head attachment elastic body having a cup-like shape is inserted in the cup-like opening. The head attachment elastic body has a flange at an outer surface, a lower surface of the flange has an annular groove to receive a rim of the cup-like opening of the probe head when the head attachment elastic body is inserted in the cup-like opening. Further, the head attachment elastic body has a plurality of elastic projections which elastically contact an inner surface of the cup-like opening of the probe head when the head attachment elastic body is inserted in the cup-like opening. Accordingly, the probe head is firmly attached to the grip thereby establishing a water tight seal.

DETAILED DESCRIPTION OF THE PREFERRED EMBODIMENTS

Figure 1:
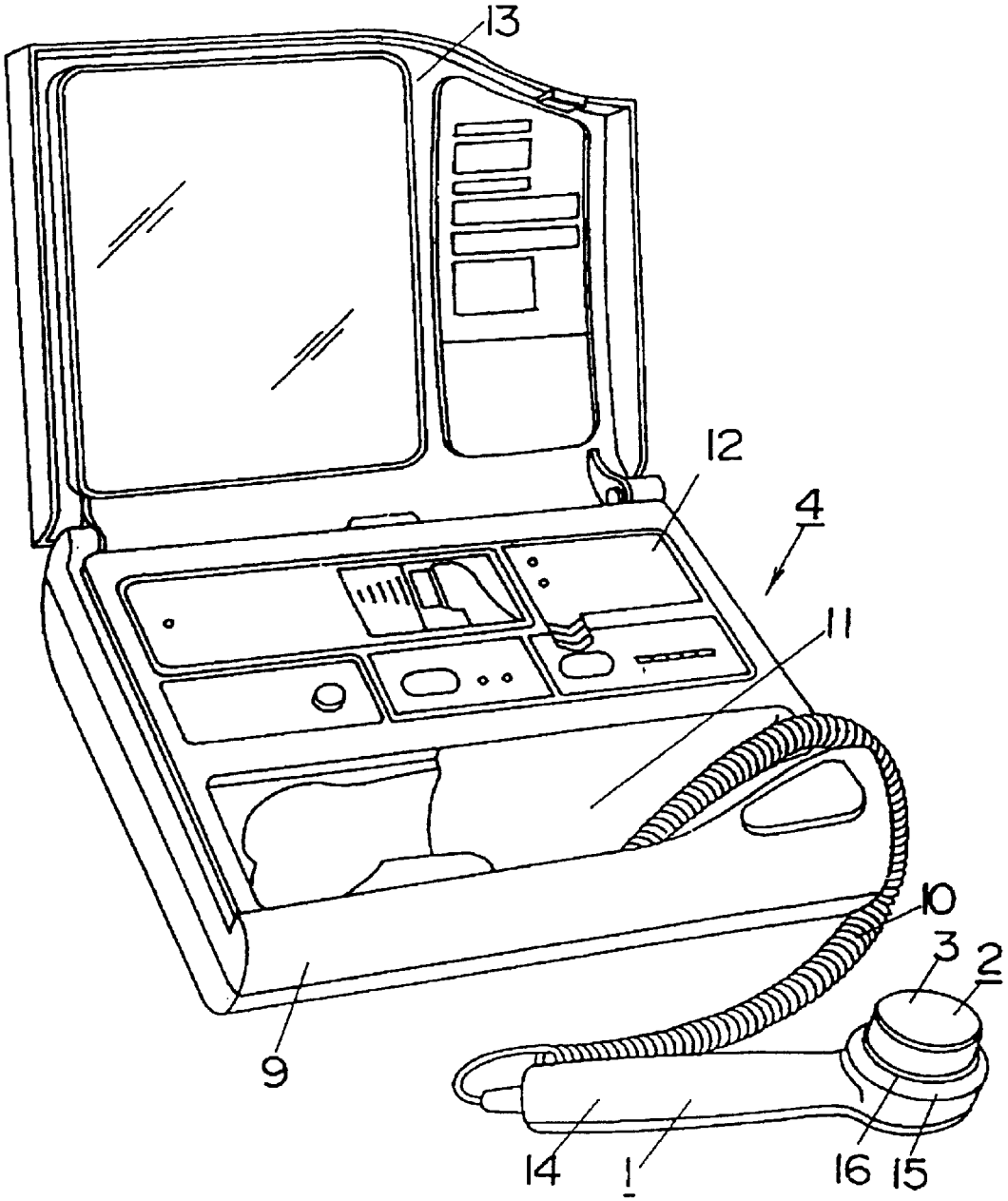
FIG. 1 is a perspective view showing an overall outer structure of the ultrasonic wave cosmetic device of the present invention.

The preferred embodiment of the present invention is described in the following with reference to the drawings. As shown in FIG. 1, the ultrasonic wave cosmetic device 4 of the present invention consists of a main case 9 which includes therein an ultrasonic wave oscillation circuit (not shown) to generate ultrasonic waves, a probe 1 which applies an ultrasonic vibration to the skin of a user, a cable 10 to connect the probe 1 and the ultrasonic wave oscillation circuit provided in the main case 9. The main case 9 further includes a probe storage compartment 11, a control panel 12, an open-close lid 13, and a power supply cable (not shown). The power supply cable is stored in a power supply cable compartment (not shown) provided in the main case 9.

In the probe 1, a head attachment 15 is provided at one end of a grip 14 as shown from FIG. 2 to FIG. 5. The probe 1 has a probe head 2 attached in an attachment opening 16 provided in the head attachment 15. The probe head 2 has an ultrasonic wave vibration element 5 (FIG. 6) which vibrates at an ultrasonic frequency in response to the output signal from the ultrasonic wave oscillation circuit in the main case 9.

Figure 2:
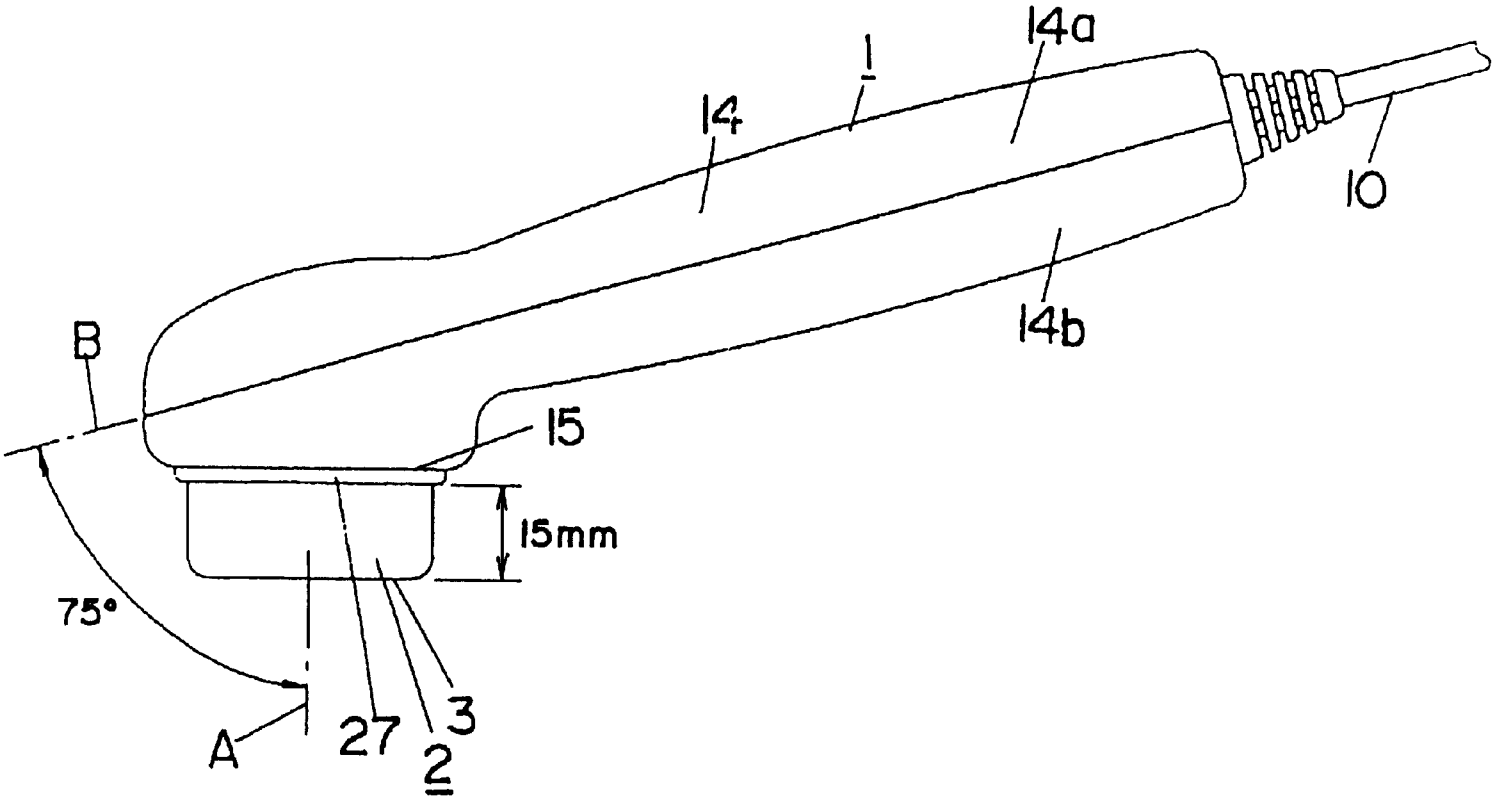
FIG. 2 is a side view of the probe of the ultrasonic wave cosmetic device of FIG. 1.
Figure 3:
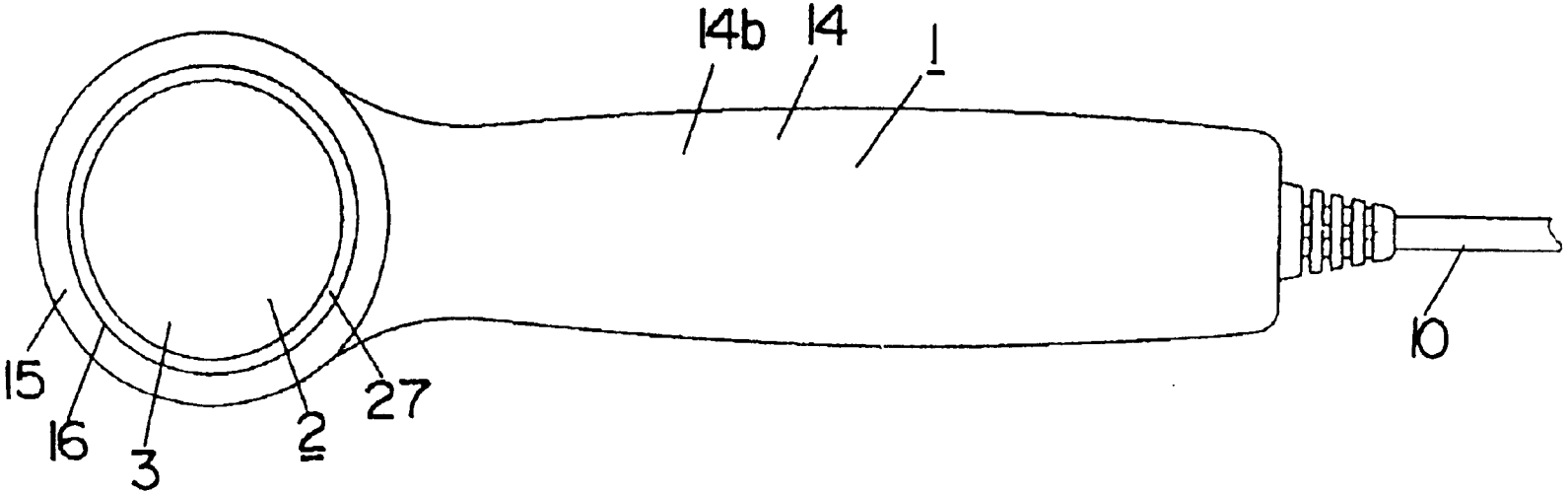
FIG. 3 is a bottom view of the probe of the ultrasonic wave cosmetic device of FIG. 1.
Figure 4:
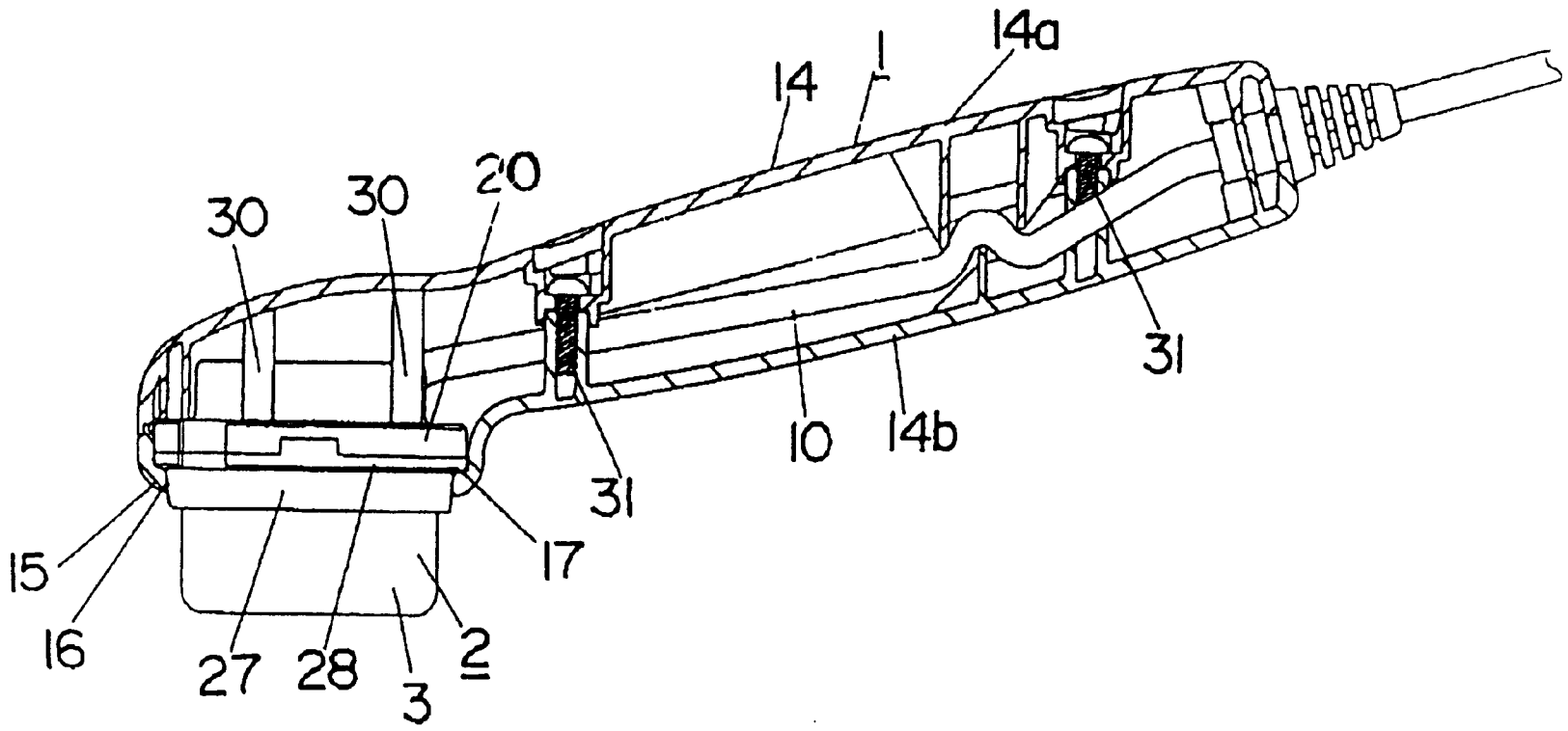
FIG. 4 is a cross sectional side view of the probe of the ultrasonic wave cosmetic device of FIG. 1.

As shown in FIGS. 2 and 4, the grip 14 is formed with an upper grip housing 14*a* and a lower grip housing 14*b* which are fastened together by screws 31. The attachment opening 16 mentioned above is formed in the lower grip housing 14*b*. A head receiving step 17 is provided at the deep end and inner circumference of the attachment opening 16 as shown in FIG. 4. Moreover, the grip 14 further includes support arms 30 at the front end of the upper grip housing 14*a* in the vertical direction of FIG. 4 to pressingly support the probe head 2 as will be described later.

Figure 6:
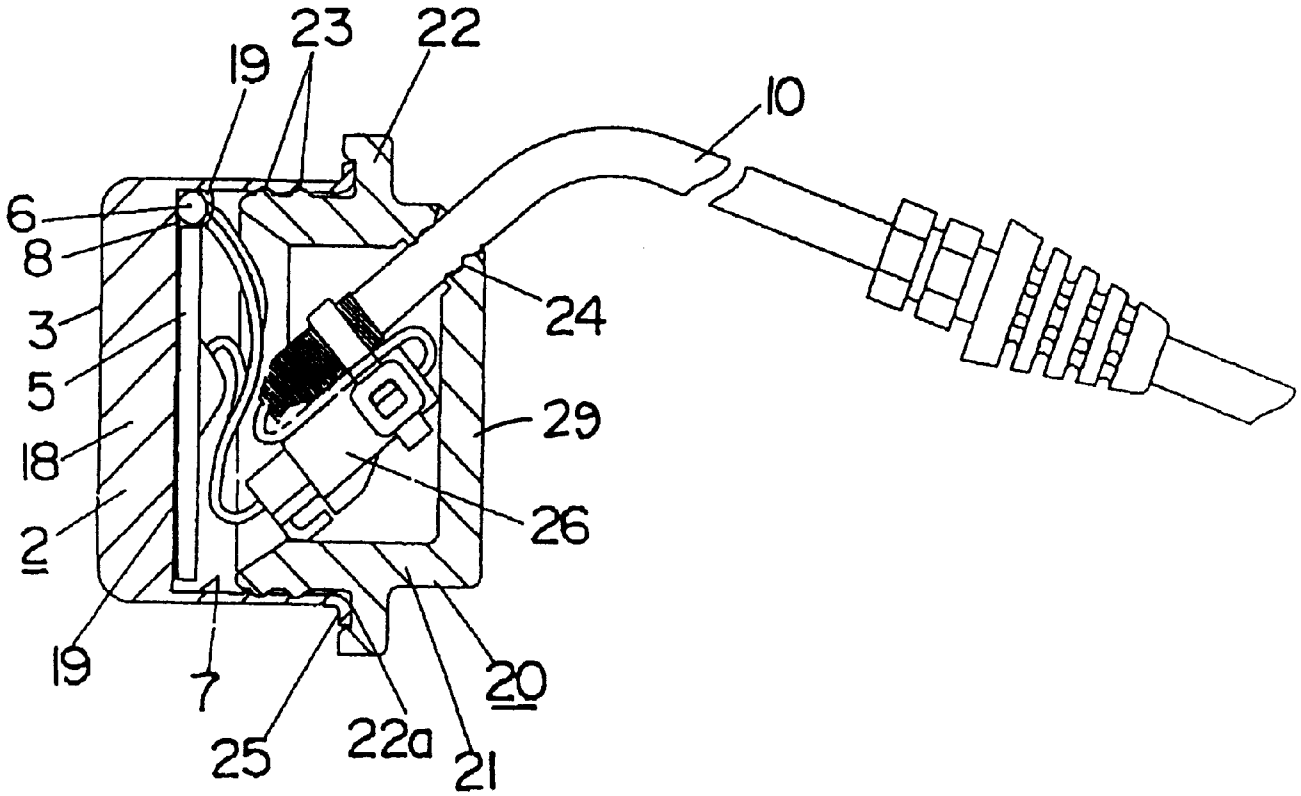
FIG. 6 is a cross sectional view of the probe of the ultrasonic wave cosmetic device of the present invention to which a head attachment elastic body is attached.

With reference to FIG. 6, the probe head 2 is made of metal and has a cup-like shape where a front end 18 of the probe head 2 is a skin contact metal surface 3 which contacts the skin. The opposite side of the skin contact metal surface 3 of the probe head 2 defines a cup-like opening 7 having the front end 18 as its bottom. The ultrasonic wave vibration element 5 is mounted on an inner surface of the bottom (front end) 18 of the cup-like opening 7 by an adhesive 19. The ultrasonic wave vibration element 5 is driven by the output signal of the ultrasonic wave oscillation circuit in the main case 9 to vibrate at ultrasonic wave frequencies. The ultrasonic wave vibration element 5 has a diameter smaller than an inner diameter of the probe head 2 so that a small space 8 is created between the ultrasonic wave vibration element 5 and the inner wall of the cup-like opening 7.

A temperature sensor 6 is installed in the small space 8 formed between the ultrasonic wave vibration element 5 and the inner wall of the opening 7. When it is mounted by the adhesive 19, the temperature sensor 6 contacts both the side surface of the ultrasonic wave vibration element 5 and the skin contact surface 3 of the probe head 2. By directly attaching the ultrasonic wave vibration element 5 and the opposite surface of the probe head 2 in this manner, the temperature sensor 6 can immediately detect any temperature changes of the vibration element and probe head.

Figure 7:
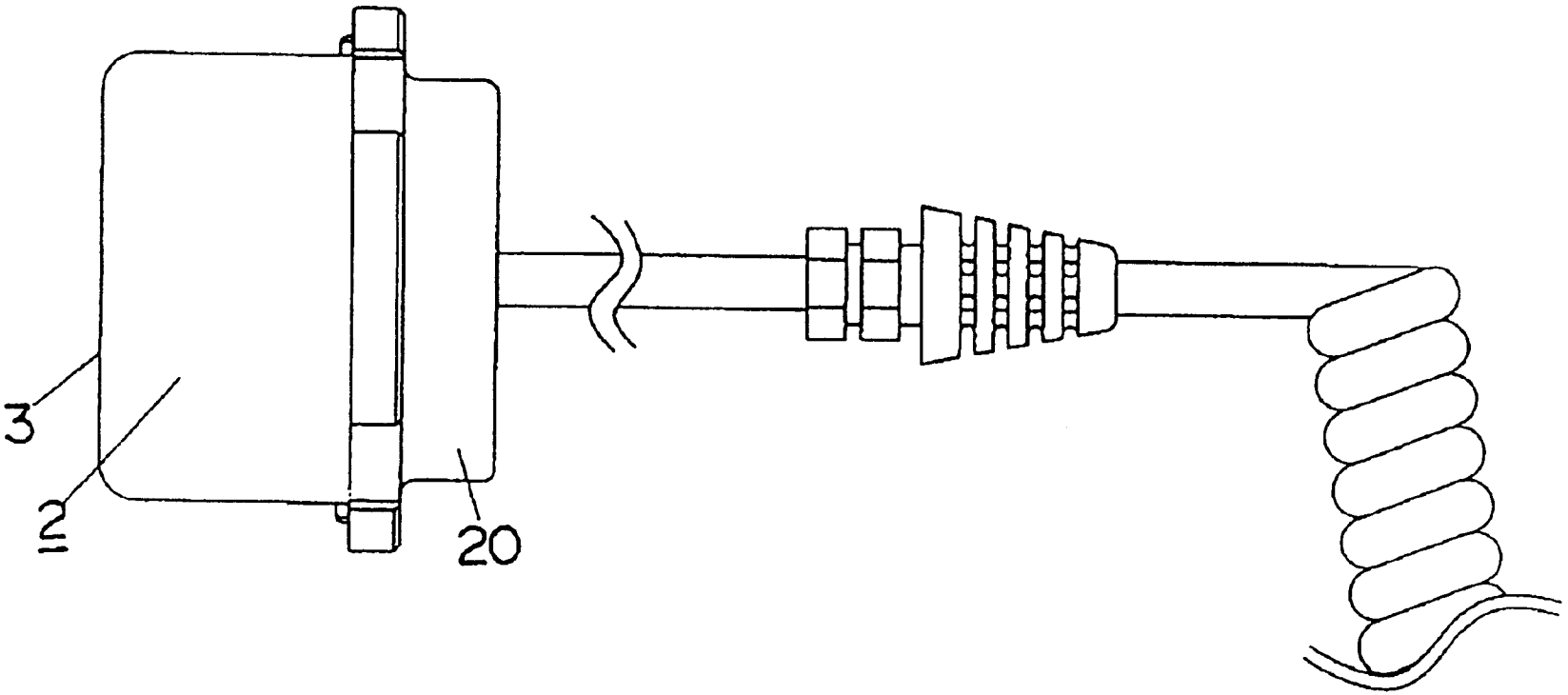
FIG. 7 is a side view of the probe of the ultrasonic wave cosmetic device of the present invention having the head attachment elastic body of FIG. 6.

As shown in FIGS. 6 and 7, a head attachment elastic body 20 which is made of an elastic material, such as rubber, is provided on the cup-like opening 7. The probe head 2 is to be attached to the grip 14 through the head attachment elastic body 20. The head attachment elastic body 20 functions to prevent the ultrasonic vibrations produced by the ultrasonic vibration element 5 from being transmitted to the grip 14. Thus, the ultrasonic wave is transmitted to the skin only through the probe head 2.

The head attachment elastic body 20 has a cup-like shape formed with a bottom portion 29 and a tubular portion 21 as shown in FIG. 6. At about a middle position of the tubular portion 21, the elastic body 20 has a flange 22 integrally formed on the outer surface of the tubular portion 21. The flange 22 has an annular groove 22*a* at an upper surface thereof facing the probe head 2 as shown in FIG. 6. Further, a plurality of elastic projections 23 are provided at the outer surface of the tubular portion 21. Preferably, the elastic projections 23 are continuous around the outer surface of the tubular portion 21 like a screw thread. The head attachment elastic body 20 also has a cable hole 24 at a corner of the bottom end thereof.

When the tubular portion 21 of the head attachment elastic body 20 is inserted in the cup-like opening 7 of the probe head 2, the plurality of elastic projections 23 elastically contact the inner wall of the cup-like opening 7 to establish a water tight seal therebetween. Further, a rim portion 25 of the cup-like opening 7 fits in the annular groove 22*a* of the flange 22.

The cable 10 which transmits the drive signal from the ultrasonic wave oscillation circuit in the main case 9 to the probe head 2 is introduced through the cable hole 24. The cable 10 also transmits a detection signal from the temperature sensor 6 to the ultrasonic wave vibration oscillator in the main case 9. The inner rim of the cable hole 24 elastically conforms the cable 10 so that a water proof seal is established therebetween. Further, because of the water proof seal, the cable 10 is tightly held in the head attachment elastic body 20. The cable 10 is connected to the ultrasonic vibration element 5 and temperature sensor 6 through a connector 26 in the head attachment elastic body 20. The connector 26 is attached to the inner wall of the head attachment elastic body 20. Thus, the cable 10 is firmly supported within the elastic body 20 by the cable hole 4 and the connector 26.

As in the foregoing, since the end of the cup-like opening 7 of the probe head 2 is provided with the head attachment elastic body 20 made of elastic materials such as rubber, the water tight seal is established to protect the electric components including the ultrasonic wave vibration element 5 in the probe head 2.

Preferably, an elastic ring 27 is provided at the outer surface of the probe head 2 as shown in FIG. 4. The upper end of the elastic ring 27 is a rim 28 which contacts the flange 22 of the head attachment elastic body 20. Although it may not be absolutely necessary, the elastic ring 27 is useful to prevent water or other unwanted objects from coming into the grip 14.

Figure 5:
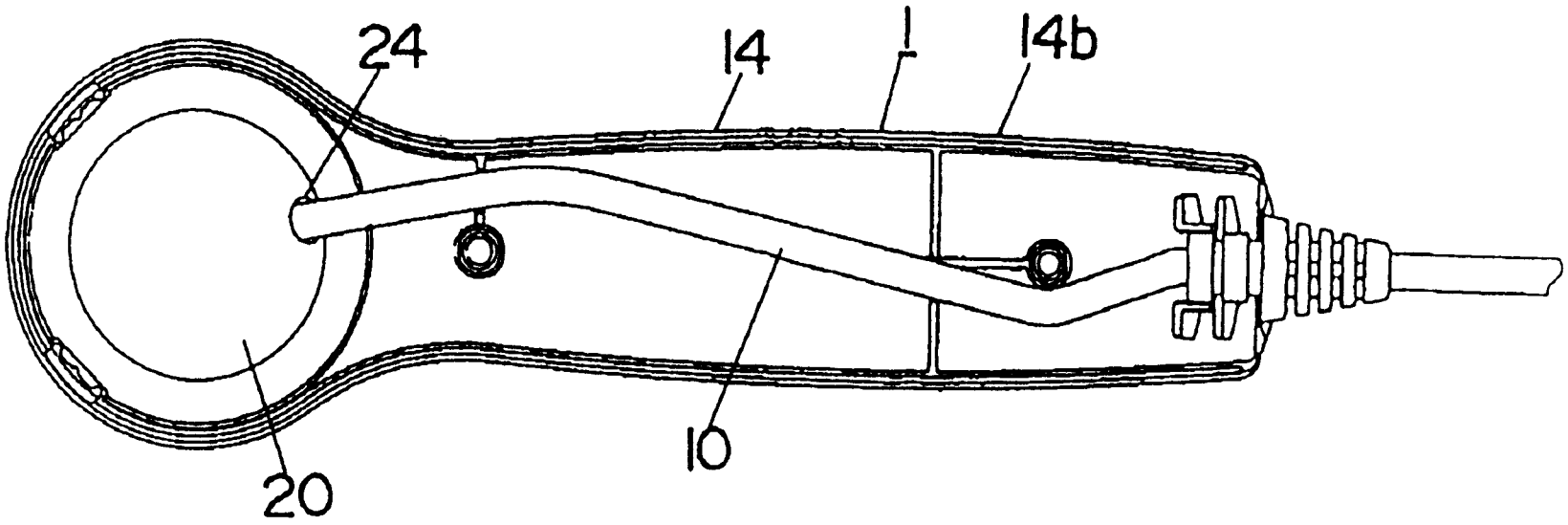
FIG. 5 is a plan view of the probe of the ultrasonic wave cosmetic device of FIG. 1 without an upper grip housing thereof.

With the elastic ring 27 and the attachment elastic body 20 thereon, the probe head 2 is fitted in the attachment opening 16 provided on the lower grip housing 14*b* as shown in FIGS. 4 and 5. The probe head 2 is inserted in the attachment opening 16 until the flange 22 of the head attachment elastic body 20 contacts the head receiving step 17 of the opening 16 through the rim 28 of the elastic ring 27. Then, the upper grip housing 14*a* and the lower grip housing 14 are fastened together by the screws 31 so that the head attachment elastic body 20 is pressed by the support arms 30 at the rear.

As in the foregoing, the probe head 2 is attached to the head attachment 15 through the head attachment elastic body 20 at the attachment opening 16. The probe head 2 is projected through the attachment opening 16 as shown in FIGS. 2 and 4. Preferably, the direction A of the probe head 2 has an angle (exterior angle) smaller than 90°, or an optimum angle of about 75°, relative to the direction B of the grip 14 as shown in FIG. 2. The projection length of the probe head 2 is, for example 15 mm, also as shown in FIG. 2. By this angle and length, the probe head 2 can smoothly provide the ultrasonic wave through the skin contact metal surface 3 to the nose or cheek of the user.

The probe 1 of the present invention configured in the foregoing applies the ultrasonic wave generated by the ultrasonic wave vibration element 5 to the skin. The ultrasonic wave is transmitted through the metal surface of the probe head 2, thereby cleaning the pores and removing the keratin from the skin as well as fitting the skin.

In the case where the ultrasonic wave cosmetic device is used in a long period of time or on a fixed spot of the skin, the temperature of the ultrasonic wave vibration element 5 as well as the skin contact metal surface 3 will rise. To prevent the possible burning or other injury to the skin, the ultrasonic wave cosmetic device of the present invention sends a detection signal from the temperature sensor 6 to the oscillation circuit through the cable 10 to temporarily terminate the vibration of the ultrasonic wave vibration element 5. For example, the temperature sensor 6 sends the detection signal when the temperature of the ultrasonic wave vibration element 5 or the skin contact metal surface 3 reaches a predetermined higher limit, such as 45° C. As a result, the oscillation signal from the ultrasonic oscillation circuit is prevented from being supplied to the vibration element 5.

Since the ultrasonic wave vibration is not active, the temperature of the ultrasonic wave vibration element 5 and the skin contact metal surface 3 decreases. When the temperature reaches a predetermined lower limit, such as 41° C., the temperature sensor 6 supplies a detection signal to the ultrasonic wave oscillation circuit. Thus, the ultrasonic wave vibration element 5 is driven again by the oscillator circuit to transmit the ultrasonic wave to the skin through the probe head 2.

The temperature sensor 6 is mounted in the space 8 in such a manner to contact the side surface of the ultrasonic wave vibration element 5 and the surface opposite to the skin contact metal surface 3 of the probe head 2. Thus, by directly contacting the ultrasonic wave vibration element 5 and the opposite surface of the probe head 2, the temperature sensor 6 can immediately detect whether the temperature reaches the higher or lower limits.

The ultrasonic wave cosmetic device of the present invention can protect the user from a burn or any such injury to the skin by restricting the temperature rise of the probe head with the use of the temperature sensor feedback. The temperature sensor is mounted in a small space formed by the side of the ultrasonic vibration element and the inner wall of the cup-like opening of the probe head in a manner to effectively sense both the temperature of the vibration element and that of the skin contact metal surface. Thus, the ultrasonic wave cosmetic device of the present invention can achieve safe operation with the use of relatively simple and low cost components.

What is claimed is:

1. An ultrasonic wave cosmetic device for treating skin, comprising:

a probe head having a skin contact metal surface for contacting the skin to transmit an ultrasonic wave to the skin, the probe head having a cup-like opening on a side opposite to the skin contact metal surface;

an ultrasonic wave vibration element mounted in the cup-like opening in the probe head for generating the ultrasonic wave by vibrating at an ultrasonic wave frequency in response to an output signal from an ultrasonic wave oscillation circuit; and a temperature sensor mounted in a space between the ultrasonic wave vibration element and an inner wall of the cup-like opening in a manner directly contacting both a side surface of the ultrasonic wave vibration element and a surface opposite to the skin contact metal surface for detecting a temperature of the probe head and supplying a detection signal to the ultrasonic wave oscillation circuit, for controlling the output signal of the ultrasonic wave oscillation circuit to maintain the temperature of the probe head lower than a predetermined level.

2. An ultrasonic wave cosmetic device as defined in claim 1, wherein the probe head is attached to one end of a grip at an exterior angle smaller than 90° relative to a longitudinal direction of the grip.

3. An ultrasonic wave cosmetic device as defined in claim 2, wherein the exterior angle relative to the longitudinal direction of the grip is about 75°.

4. An ultrasonic wave cosmetic device as defined in claim 1, wherein the probe head is attached to one end of a grip having an attachment opening where the grip is formed with an upper grip housing and a lower grip housing.

5. An ultrasonic wave cosmetic device as defined in claim 1, wherein the probe head is attached to one end of a grip and has a cup-like opening in which the ultrasonic wave vibration element is mounted, and a head attachment elastic body having a cup-like shape is inserted in the cup-like opening.

6. An ultrasonic wave cosmetic device as defined in claim 5, wherein the head attachment elastic body has a flange at an outer surface, and one surface of the flange has an annular groove to receive a rim of the cup-like opening of the probe head when the head attachment elastic body is inserted in the cup-like opening.

7. An ultrasonic wave cosmetic device as defined in claim 5, wherein the head attachment elastic body has a plurality of elastic projections which elastically contact an inner surface of the cup-like opening of the probe head when the head attachment elastic body is inserted in the cup-like opening, thereby establishing a water tight seal.

8. An ultrasonic wave cosmetic device as defined in claim 7, wherein an elastic ring is provided at the outer surface of the probe head which is inserted by the head attachment elastic body therein, and the probe head is fitted in an attachment opening provided at one end of the grip until the flange contacts a head receiving step on the attachment opening through the elastic ring.

9. An ultrasonic wave cosmetic device as defined in claim 5, wherein the head attachment elastic body is made of rubber.

* * * * *